US006447310B1

(12) United States Patent
Brown

(10) Patent No.: US 6,447,310 B1
(45) Date of Patent: Sep. 10, 2002

(54) ELECTRICAL CONNECTOR HAVING A STABILIZER

(75) Inventor: Robert William Brown, Harrisburg, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/922,993

(22) Filed: Aug. 3, 2001

(51) Int. Cl.[7] ..... H01R 13/648
(52) U.S. Cl. ..... 439/108; 439/608; 439/381
(58) Field of Search ..... 439/660, 101, 439/108, 701, 695, 608, 381

(56) References Cited

U.S. PATENT DOCUMENTS 5,542,851 A * 8/1996 Chikano ..... 439/608
6,042,394 A * 3/2000 Mitra et al. ..... 439/608
6,171,154 B1 * 1/2001 Juntwait et al. ..... 439/381
6,290,515 B1 * 9/2001 Lee ..... 439/108

* cited by examiner

*Primary Examiner*—Gary F. Paumen
(74) *Attorney, Agent, or Firm*—Wei Te Chung

(57) ABSTRACT

An electrical connector includes an insulative housing (1), a plurality of molded ground buses (2), a plurality of terminals (3), and a stabilizer (4). The housing includes a pair of side walls (12), a pair of end walls (13), a mating face (140) and a bottom wall (15) which together define a cavity (14). The stabilizer defines a plurality of through holes (46). The molded ground buses and signal terminals are inserted in the cavity and secured with a bottom wall (15) of the housing. The stabilizer is inserted into the cavity and adjacent to the mating face with the terminals and molded ground buses extending through the corresponding through holes of the stabilizer and being organized therein. This stabilizer supports the side walls to prevent the side walls from deformation.

1 Claim, 6 Drawing Sheets

ELECTRICAL CONNECTOR HAVING A STABILIZER

BACKGROUND OF THE INVENTION

1. Field of the Invention

The present invention relates to an electrical connector, and particularly to an electrical connector having a stabilizer for preventing the housing from deformation.

2. Description of Related Art

An elongate electrical connector has a pair of elongate parallel side walls and a pair of end walls connected with the side walls. When the connector is very high and thin, the two side walls will deform to arc. End portions of the side walls adjacent to the end walls have a little deformation and middle portions of the side walls have a large deformation. Cooling speeds of the end portions and of the middle portions are different after the side walls are insert molded. When the side walls are completely cooled, internal stress remains in the side walls to cause deformation. In the prior art, some solving methods are adopted, such as disposing a metal plate in the side wall before the side wall are insert molded. In this method, the side wall must provide enough thickness to dispose the metal plate; to the connector having high and thin side walls, the metal plate is not adopted. Another method to correct for the molded-in bow is to build the mold tooling with an opposite bow. When the side walls are molded, the side walls will be parallel and the bow will be avoided.

SUMMARY OF THE INVENTION

Accordingly, the object of the present invention is to provide an electrical connector having a stabilizer assembled therein to prevent a pair of side walls thereof from deformation.

In order to achieve the object set forth, an electrical connector has an insulative housing, a plurality of molded ground buses, a plurality of signal terminals, and a stabilizer. The housing has a pair of high and thin side walls, a pair of end walls connecting with the side walls, a mating face, and a bottom wall opposite the mating face where all the walls together define a cavity. The stabilizer defines a plurality of through holes from an upper face through a bottom face thereof. The signal terminals and the molded ground buses are formed with a plurality of interfering portions. The molded ground buses and signal terminals are assembled in the cavity with the interfering portions interfering and secured with the bottom wall of the housing. The stabilizer is inserted into the cavity adjacent to the mating face of the housing with the terminals and molded ground buses extending through the corresponding through holes of the stabilizer and organized therein. This stabilizer supports both side walls and both end walls to prevent the side walls from deformation.

Other objects, advantages and novel features of the invention will become more apparent from the following detailed description when taken in conjunction with the accompanying drawings.

DETAILED DESCRIPTION OF THE INVENTION

Figure 1:
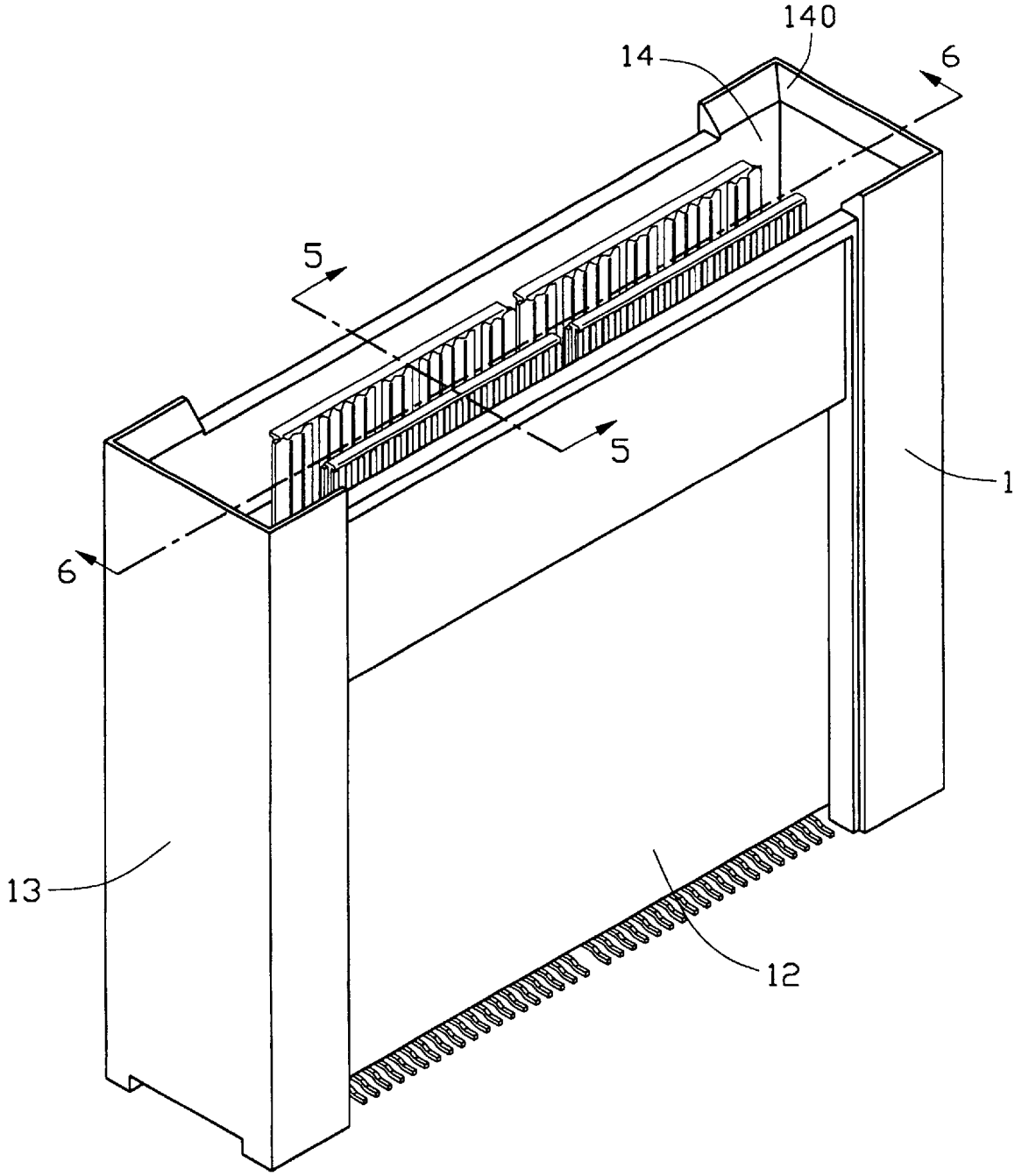
FIG. 1 is a perspective view of an electrical connector of the present invention.

Referring to FIG. 1, an electrical connector of the present invention comprises an insulative housing 1, a plurality of molded ground buses 2, a plurality of high and thin signal terminals 3, and a stabilizer 4.

Figure 5:
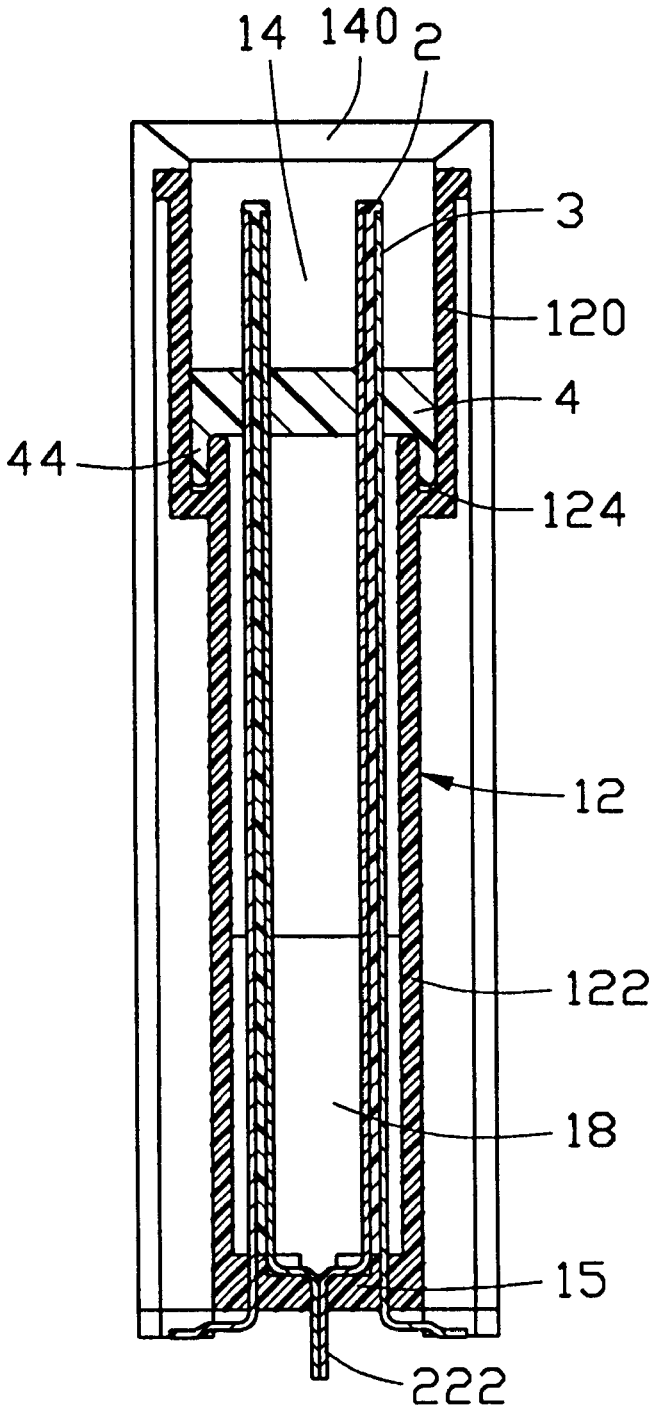
FIG. 5 is a cross-sectional view of FIG. 1 taken along line 5—5.
Figure 6:
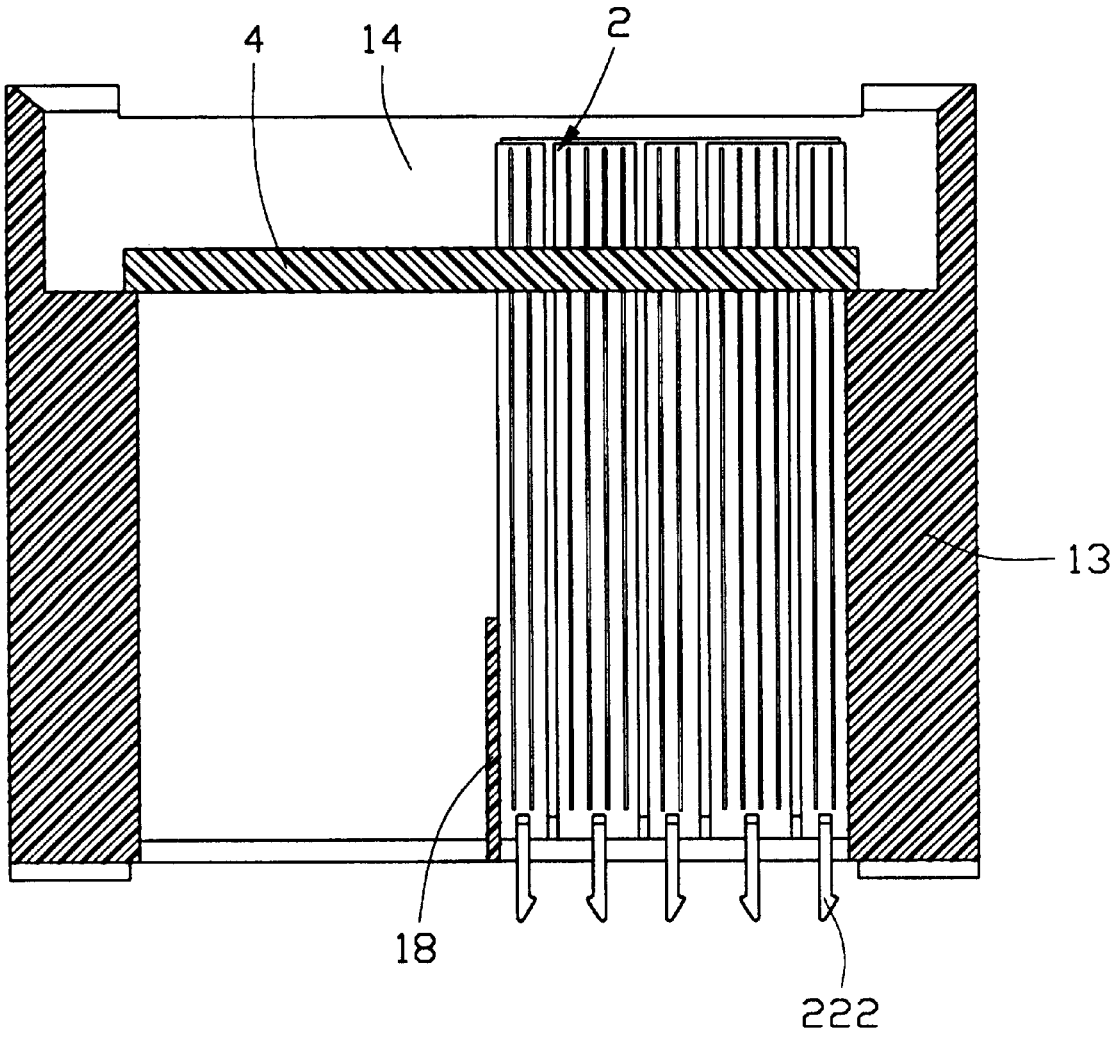
FIG. 6 is a cross-sectional view of FIG. 1 taken along line 6—6.

The insulative housing comprises a pair of side walls 12, a pair of end walls 13 connected with the side walls 12, a mating face 140, and a bottom wall 15 opposite the mating face 140. The side walls 12, the end walls 13, the mating face 140 and the bottom wall 15 together define a cavity 14. Referring to FIGS. 5 and 6, each side wall 12 comprises an upper section 120 and a lower section 122 connected with the upper section 120. A first distance is defined between both lower sections 122, and a second distance is defined between both upper sections 120. The second distance is larger than the first distance. A slot 124 is defined between the upper section 120 and the lower section 122. A spacing wall 18 extends from the bottom wall 15 into the cavity 14 to separate the cavity 14 into two areas.

Figure 2:
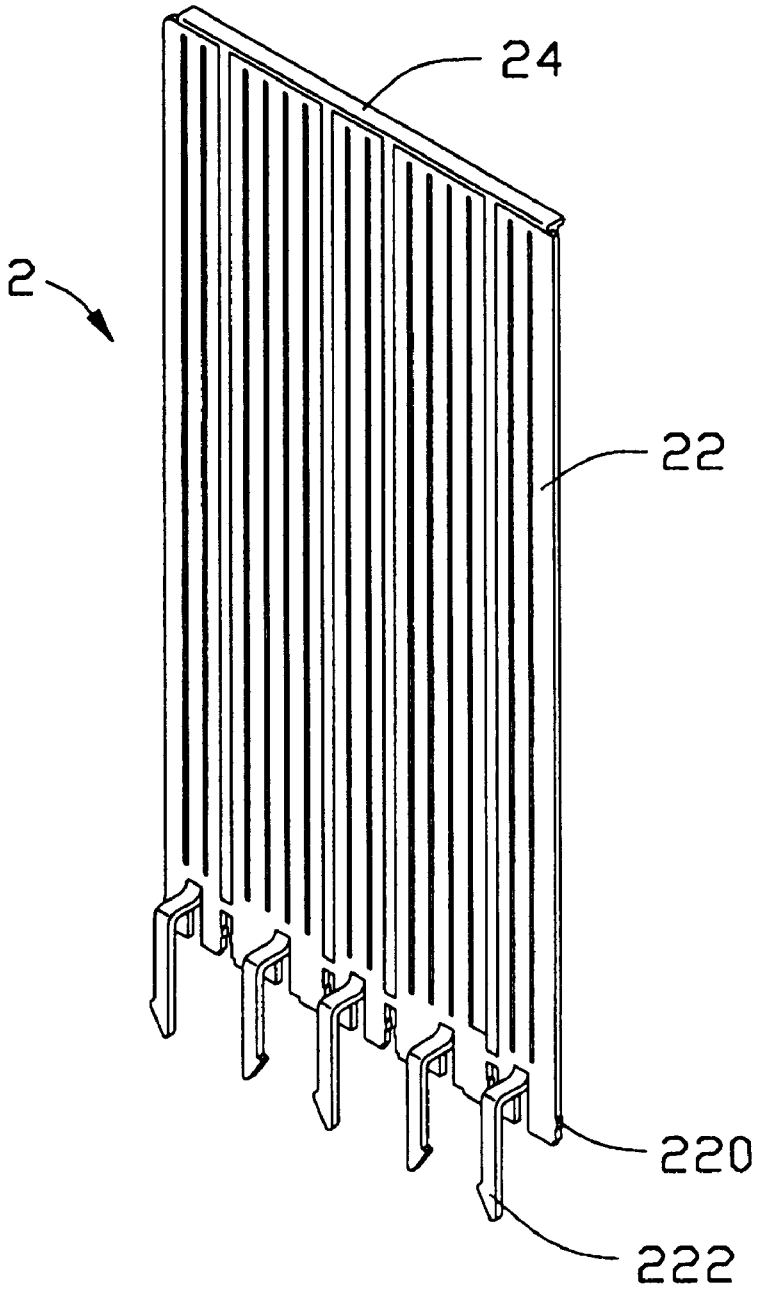
FIG. 2 is a perspective view of a molded ground bus of the electrical connector.
Figure 3:
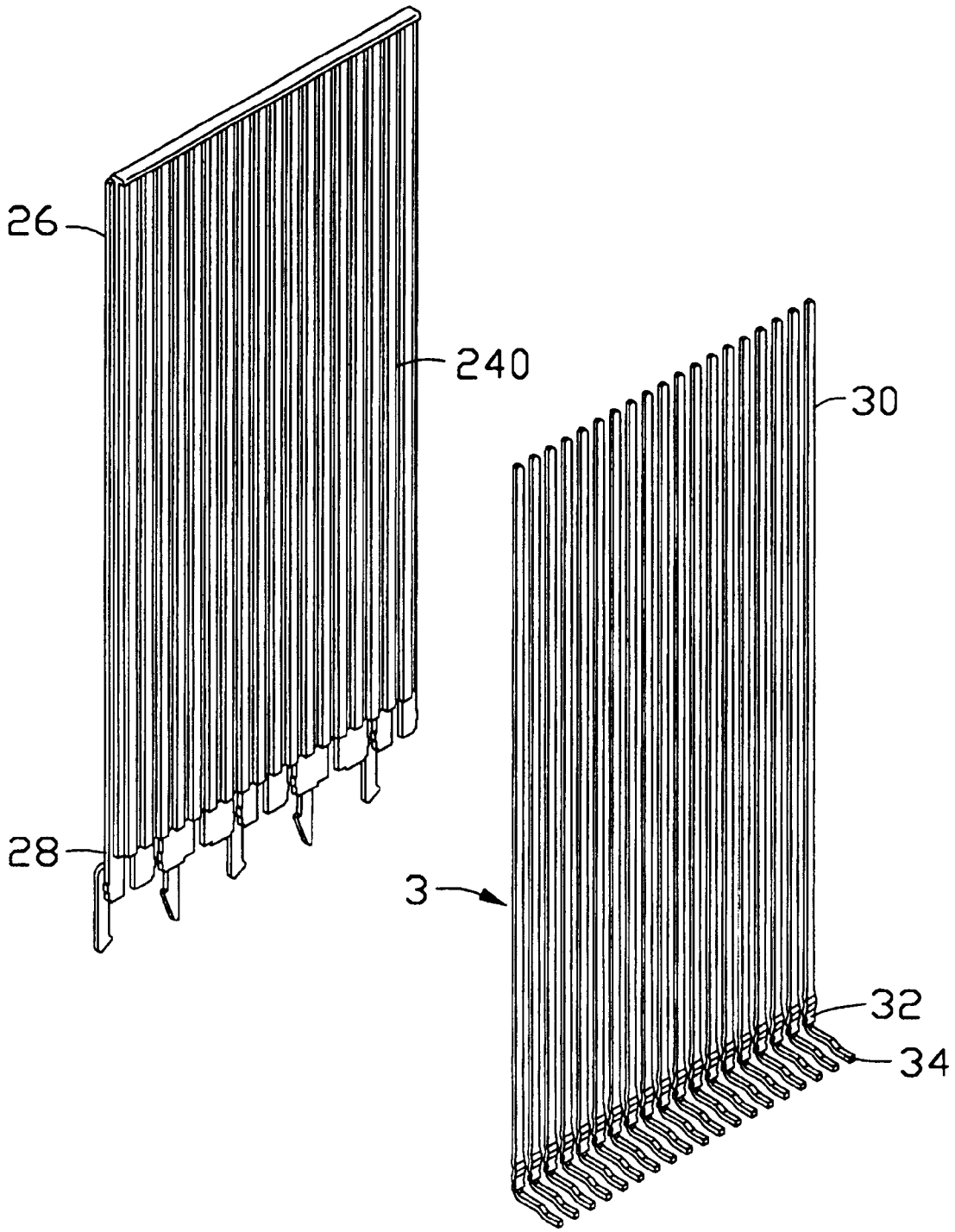
FIG. 3 is a perspective view of a plurality of terminals and the molded ground bus.

Referring to FIGS. 2 and 3, the molded ground bus 2 comprises a ground plate 22 and a plastic member 24 insert molded with the ground plate 22. The molded ground bus 2 has an upper end 26 and a lower end 28. The ground plate 22 comprises a plurality of interfering portions 220 at the lower end of the molded ground bus 2 for interfering with the housing 1 and a plurality of ground pins 222 bent and extending downwardly. The plastic member 24 defines a plurality of receiving passageways 240 extending from the upper end 26 to the lower end 28 for receiving the terminals 3. Each terminal 3 comprises a contact portion 30 at one end thereof, a solder portion 34 at the other end thereof and bent to perpendicular to the contact portion 30, and an interfering portion 32 connected between the contact portion 30 and the solder portion 34 for interference fitting with the housing 1.

Figure 4:
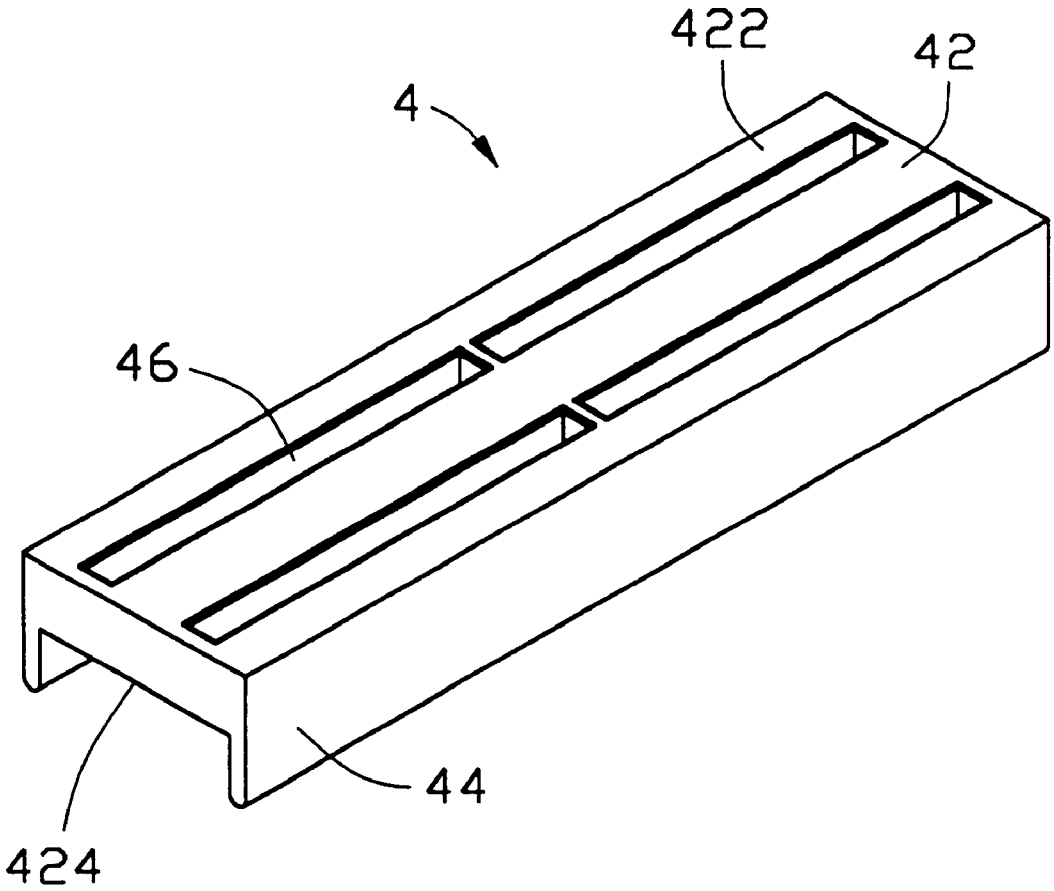
FIG. 4 is a perspective view of a stabilizer of the electrical connector.

Referring to FIG. 4, the stabilizer 4 comprises a main portion 42 and a pair of lateral walls 44 extending downwardly The main portion 42 defines a plurality of through holes 46 through an upper face 422 and a bottom face 424 thereof.

In assembly, the molded ground buses 2 are downwardly inserted into the cavity 14 of the housing 1 with the interfering portions 220 being interferentially and secured with the bottom wall 15 of the housing 1. The ground pins 222 extend out of the bottom wall 15. The terminals 3 are upwardly inserted into the cavity 14 and extend into corresponding passageways 240 with the interfering portions 32 interfering and securing with the bottom wall 15. The stabilizer 4 is inserted into the cavity 14 from the mating face 140 and the upper end 26 of the molded ground bus 2 and the contact portions 30 of the terminals 3 extend through the through holes 46 from the bottom face 424 to the upper face 422 until both lateral walls 44 are inserted into the slots 124 thereby securing the stabilizer 4 into the housing 1 adjacent to the mating face 140. The stabilizer 4 organizes the molded ground bus 2 and contact portions 30 thereby-facilitating a mating connector (not shown) to mate therewith. When the stabilizer is secured in the housing 1, the stabilizer 4 will support the side walls 12 and the end walls 13 of the housing 1 to prevent the side walls 12 from deformation to an arcuate profile.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing having a pair of side walls, a pair of end walls connected with the side walls, a mating face, and a bottom wall which together define a cavity;

a plurality of molded ground buses received in the cavity and secured in the bottom wall;

a plurality of signal terminals received in the cavity and secured in the bottom wall;

a stabilizer inserted into and secured in the cavity, the stabilizer being adjacent to the mating face and having a plurality of through holes, the molded ground buses and the terminals extending through and organized in the through holes, the stabilizer supporting the side walls to prevent the side walls from deformations;

wherein the stabilizer comprises a main portion and a pair of lateral walls with the through holes being defined in the main portion;

wherein each side wall comprises an upper section and a lower section, a pair of slots is defined between the upper sections and the lower sections of the side walls, and the lateral walls are inserted and secured in the slots;

wherein each molded ground bus comprises a ground plate and a plastic member insert molded with the ground plate;

wherein the ground plate has a plurality of interfering portions interference fitted with the bottom wall of the housing;

wherein each terminal comprises a contact portion at one end thereof, a solder portion at the other end thereof, and an interfering portion between the contact portion and the solder portion interference fitted with and secured in the bottom wall of the housing;

wherein the plastic member has a plurality of passageways receiving corresponding contact portions of the terminals.

* * * * *